United States Patent [19]

Fegley

[11] Patent Number: 4,586,608

[45] Date of Patent: May 6, 1986

[54] CONTAINER FOR AND METHOD OF ENCLOSING AN ARTICLE

[75] Inventor: Charles R. Fegley, Laureldale, Pa.

[73] Assignee: AT&T Bell Laboratories, Murray Hill, N.J.

[21] Appl. No.: 623,899

[22] Filed: Jun. 25, 1984

[51] Int. Cl.[4] ..... B65D 73/02

[52] U.S. Cl. ..... 206/334; 220/356; 220/366

[58] Field of Search ..... 220/352, 366, 356; 206/328, 334

[56] References Cited

U.S. PATENT DOCUMENTS

| | | | |
|---|---|---|---|
| 577,794 | 2/1897 | Stickney | 206/366 |
| 1,495,100 | 5/1924 | Nurnberg | 206/306 |
| 1,819,279 | 8/1931 | Coyle | 220/366 |
| 1,953,765 | 4/1934 | McCluney | 220/366 |
| 3,429,653 | 2/1969 | Brett | 220/366 |
| 3,552,548 | 1/1971 | Wallestad et al. | 206/1 |
| 4,061,226 | 12/1977 | Essen | 206/306 |
| 4,296,998 | 10/1981 | Dufft | 350/96.20 |
| 4,358,908 | 11/1982 | Song | 220/366 |

FOREIGN PATENT DOCUMENTS

| | | | |
|---|---|---|---|
| 772884 | 11/1934 | France | 220/366 |
| 269307 | 4/1927 | United Kingdom | 206/306 |

OTHER PUBLICATIONS

G. M. Geany et al., Article entitled "Self-Sealing Shake-Proof Wafer Carrier" *IMB Technical Disclosure Bulletin,* vol. 19, No. 6, Nov., 1976.

L. Hershoff, Article entitled "Wafer Package", *IBM Technical Disclosure Bulletin,* vol. 8, No. 11, Apr., 1966.

W. J. Pinckney et al., Article entitled "Self-Pressurized Container with Pressure Clamp", *IBM Technical Disclosure Bulletin,* vol. 15, No. 11, Apr., 1973.

*Primary Examiner*—Joseph Man-Fu Moy

*Attorney, Agent, or Firm*—Wendy W. Koba

[57] ABSTRACT

A container (30) for enclosing an article (10) includes a base (32) having a bore (33) and a counterbore (34) for holding the article (10) such that a first, often delicate, portion protrudes from a first end of base (32). Base (32) has peripheral surfaces (37) primarily for engaging a cover (40) for closing container (30). The cover (40) has an interior cavity (42) and portions (53-55) which close over and limit air entrapped with the article (10). Cover (40) also has peripheral walls (48) containing fixed ends (49) and free ends (50) with internal surfaces (51) therebetween for engaging the base (32). The engagement surfaces (37 and 51) of the base (32) and cover (40), respectively, preferably have an interference fit. Also, the cover walls (48) are sufficiently long that the cover (40) substantially aligns to base (32) and stays clear of article (10) during closure. Accordingly, unwanted contact of cover (40) to the first portion of the article is avoided. The base (32) may also include engagement walls (63), channels (64) and a port (69). The walls (63) flex inwardly to accommmodate the interference fit between engagement surfaces (37 and 51) and flex outwardly to improve engagement when a pressure differential over walls (63 and 48) reaches a given value. Internal air is minimized because air is passed through the channels (64) and the port (69) during closure until the cover walls (48) seal port (69).

6 Claims, 5 Drawing Figures

FIG.-1
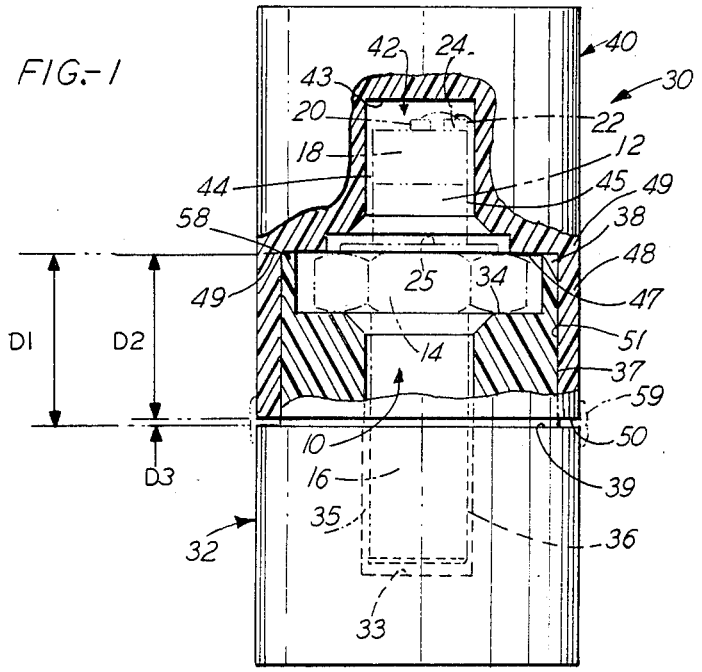
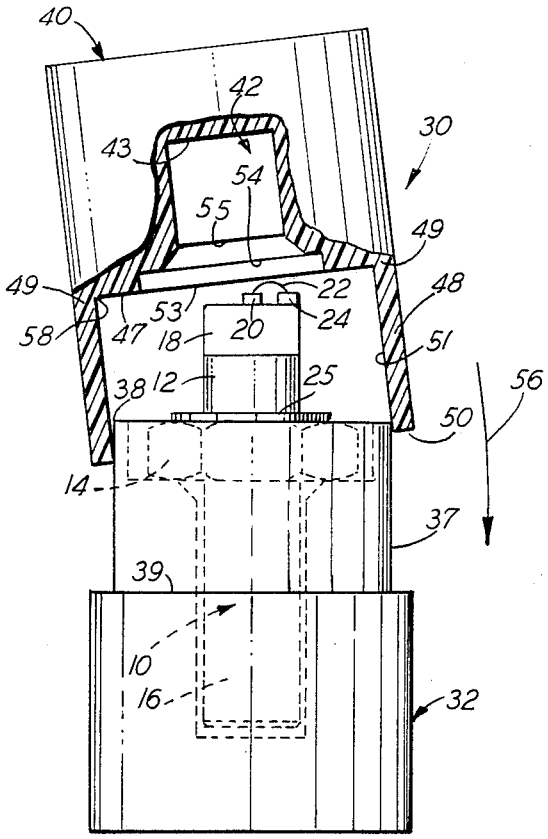
FIG.-1A

CONTAINER FOR AND METHOD OF ENCLOSING AN ARTICLE

This invention relates to containers for and methods of enclosing articles. More particularly, the invention relates to containers and methods which protect, from various handling and environmental dangers, separated articles having delicate features.

BACKGROUND OF THE INVENTION

Individual containers are sometimes provided for separately handling small articles, especially for handling articles having intricate or delicate features. Such features may be readily damaged by mechanical and environmental forces. Typical articles include electronic devices which are not yet fully, individually enclosed in a service package designed to protect vulnerable chips and bonded wires. Such devices may be shipped between remote locations and along routes having disparate climates. Damage may occur during shipment or during packing and unpacking the devices.

Such containers typically include a portion such as a base having an opening to receive at least a portion of an article and a cover for closing over the article and the base opening. Closure may be achieved by sleeve portions of the base or cover which typically overlap and form a joint. In packing an article, sometimes a vulnerable feature is permitted to protrude from the base for ease of handling or inspection or to permit a cover to selectively bear against other portions of the article. A problem is to apply and remove such a cover without contacting the vulnerable features of such an article.

Damage may also occur by an article moving about in a relatively unrestrained manner and striking internal portions of a container during handling. To prevent such damage, shock absorbing media (such as foam particles) are typically packed in a container with an article. A problem is that such media may be untidy or expensive or both. Another problem is that the media does not always protect and may itself damage delicate wires and chips typically found on electronic devices. A further problem is that an article does not readily assume a posture acceptable for opening or closing a container or removing the article without risk of damage. Sometimes caps, resembling thimbles, are affixed to delicate features on an article for protection. But the application and removal of such caps is also sometimes destructive of features and additional costs are incurred in their application.

A further problem is that a cover does not always close onto a base in an airtight, contamination resistant manner. Even when an adherent fabric is used to seal over a joint, a change in air pressure or temperature sometimes causes a cover to open and admit air. Special mechanical closures and air control valves may be utilized on containers, but they are complex and the extra cost is generally not justified.

Accordingly, it is desirable to develop new and improved containers for articles, especially for individually packaged, small articles having delicate features. Such containers should overcome or alleviate problems of the prior art and be simple, sturdy and inexpensive.

SUMMARY OF THE INVENTION

Containers are provided for enclosing articles such as devices having delicate features which are vulnerable to damage from handling and environmental effects. In one embodiment, a base has an interior support containing a bore for holding a device with a first, often vulnerable, portion protruding from a first end of the base. The base also has peripheral surfaces extending over a first distance from the first end to a shoulder. Such shoulder may support a fabric for sealing a joint. The peripheral surfaces are provided primarily for engaging cooperating surfaces for closure of the container.

In an embodiment involving the described base, a cover is provided having an interior cavity for closing over the vulnerable portion of the device. For example, the cavity may be a bore which is just wide enough to clear a cylindrical portion of a device such that sidewalls of the bore will laterally oppose movement of the device. The cover also has peripheral walls containing fixed ends and free ends with internal surfaces therebetween for engaging the engagement surfaces of the base.

In a further embodiment, the engagement surfaces of the base and cover have a sufficiently close fit, and the peripheral walls of the cover are sufficiently long that the cover substantially aligns to the base and stays clear of the device during closure such that unwanted contact of the cover to the vulnerable portion of the device is avoided.

In another embodiment, the peripheral surfaces are provided on walls on the base, such walls being substantially separated from the interior support. The walls are flexibly cantilevered from the base by provision of channels inwardly adjacent to the walls. The channels are of sufficient depth that the walls resiliently flex inwardly to accommodate a desired interference fit with the cover during closure. The walls also are resiliently flexible outwardly to flex against and improve engagement to the cover when internal air pressure rises above external air pressure. An air relief port may be provided in such base walls adjacent to a cover terminating region to advantageously relieve air from around the device during closure.

BRIEF DESCRIPTION OF THE DRAWINGS

The invention will be more readily understood from the following detailed description when read in conjunction with the drawing wherein:

FIG. 1 is a partially sectioned, elevation view of a container for enclosing a device having delicate features;

FIG. 1A is a partially sectioned, elevation view of the container shown in FIG. 1 showing how a cover aligns to a base during closure;

Figure 2:
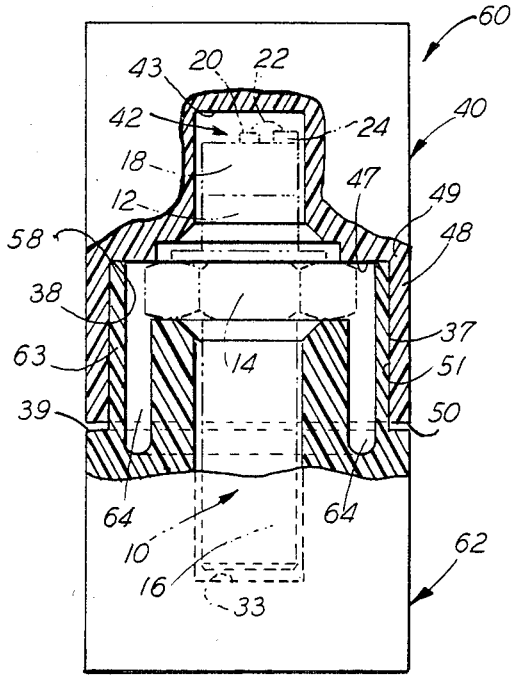
FIG. 2 is a partially sectioned, elevation view of a container having flexible, cantilevered walls formed by channels in a base.

Some of the elements in the figures are abbreviated or simplified to highlight features of the invention. Also, where appropriate, reference numerals have been repeated in the figures to designate the same or corresponding features in the drawing.

DETAILED DESCRIPTION

The Articles

FIGS. 1–4 show (in phantom lines) a typical article 10 which may be enclosed in the practice of the invention. For purposes of illustration and discussion, article 10 will also be referred to herein as a device 10 for several reasons. In common usage, a "device" is believed to be an elaborate or intricate article or a mechanism which serves a special purpose. Hence such a device may have features deserving protection in a container according to the instant invention.

A "device" is also known in the electronics industry as an item which performs a desired function. The particular device 10 shown in the figures is typical of a partially assembled, lightwave generating mechanism. The device 10 includes a cylindrical body 12 attached to a hex nut 14 and a threaded stud 16 for mounting to a service assembly (not shown). Body 12 supports a wall 18 on which there is mounted a laser chip 20 which is connected by a wire 22 to a ceramic block 24.

Mounting the chip 20, the block 24 and bonding the ends of wire 22 to items 20 and 24 is a demanding and expensive operation. For example, chip 20 may be about 8 mils wide by about 15 mils long by about 4 mils thick. Chip 20 may include a gallium arsenide substrate and several layers of epitaxially grown compounds in a structure which is very brittle. Accordingly, it is difficult to mount such a chip 20 precisely and protect the chip and the interconnecting wire 22 from being destroyed or dislodged. For these reasons, a sturdy service housing (not shown) is normally applied to a concentric pad 25 to surround and protect items 12, 18, 20, 22 and 24. Unfortunately, prior to installing the service housing, such a device 10 is often unprotected when it must be handled and even shipped over long distances. Moreover, the current value of a device 10 is so high that good protection is justified.

It will be appreciated that the device 10 shown in the figures and described herein is only one of many articles which may be enclosed in a container in the practice of the invention. An article 10 need not be an electronic device nor even an article having such a delicate portion which is vulnerable to injury. Article 10 may be any article having features which are significantly valuable that one would expend the expense of enclosing the article in a container in the manner to be described.

Protecting The Articles

A prior art method of protecting an article such as a device 10 for handling was to slip a plastic cap, resembling a thimble (not shown), over the portions supported by pad 25. The thimble had a domed shape with a cylindrical cavity at one end which was closely fitted to body 12. The thimble did a reasonably good job of protecting the vulnerable portion of device 10. However, it was surprising how many times an operator contacted and damaged chip 20, wire 22 or block 24 in applying or removing the protective thimble. It was also disconcerting to find that plastic thimbles tended to shed fine and unnoticeable debris upon a chip 20 or the bonding sites for wire 22. Such debris tended to stick to and interfere with critical operating portions of the device 10.

Another problem in the prior art was to fully enclose and pack a device 10 for shipping after vulnerable portions were protected. A typical container included a hollow, tubular base and cover, each having a closed end. The cover may have been larger in diameter to slip over the base or have thick walls which were circumferentially reduced to partially slip within the base to facilitate closure. Such closures were unreliable and did not always resist the disengagement forces experienced in shipping. For example, when a cargo depressurizes in air transit, the pressure differential between the interior and exterior of a container can range up to about 10 psi. Also, shipping temperatures may range from about 110° F. down to about −50° F. Some of these environmental conditions can cause either offsetting or additive effects on containers. However, the net effects have been sufficient to sometimes open the prior art containers and deleteriously affect vulnerable portions of expensive devices.

FIG. 1 shows a desirable container 30 having a base 32 and a cover 40 for protecting a device 10 described previously. Container 30 is preferably made of an impact resistant plastic having further properties suitable to the function of each portion. For example, a butadiene-styrene compound may be used for the cover 40 to make it desirably resistant to flexing and to make it transparent to the interior of container 30. A polypropylene compound may be used for the base 32 to make it readily machineable or moldable, and so surface portions are reasonably compliant and frictional under pressure from the cover 40.

Although the container 30 is shown with a preferably cylindrical shape for the device 10 shown in the figures, it is to be understood that such a shape is not necessary to the invention. For example, the container 30 could have other cross-sectional shapes (with preferably rounded corners) to suit other or even multiple articles, in the practice of the invention. Moreover, if a container 30 need not be airtight for a desired purpose, some features need not be peripherally continuous. Therefore, features such as, but not limited to surfaces and walls, may be designated in a plural manner herein even though such features may be peripherally continuous and even though the features may normally be described in a singular manner for a cylindrical container.

Base 32 has an interior bore 33 and a counterbore 34 for holding device 10 with a first portion protruding from a first (loading) end of the base. The first portion will be recognized as the portion containing a delicate chip 20, wire 22 and connector block 24. Note that the bore 33 retains stud 16 with slight clearances 35 and 36 to prevent lateral excursions and collisions of device 10 with inside features of container 30. Hex nut 14 rests on shoulders 34 of base 32 to provide, in cooperation with bore 33, a desired posture for the device 10 within container 30.

Base 32 also has peripheral surfaces 37 which extend over a first distance from corner portions 38 to a cover terminating portion of the base 32. In a preferred embodiment, such cover terminating portion includes shoulder portions 39 and associated features to be explained later.

The material and texture of surfaces 37 and their extension over the first distance are selected primarily for engaging cooperating surfaces for closure of the container. For example, FIG. 1 shows that a distance D2 of a total distance D1 is utilized for engagement and a slight distance D3 is used for other purposes to be explained later.

In association with base 32, there is provided a cover 40 having an interior cavity 42 for closing over the protruding, first portion of device 10 (and portions of the base 32) in a desired manner. For example, the end surface 43 of cavity 42 is set to clear the items 20, 22 and 24 and the clearances 44 and 45 are set to prevent lateral excursions of device 10 and collisions with internal features of cover 40. Shoulder portions 47 of cover 40 are provided to bear against hex nut 14, to restrain device 10 from longitudinal movement and collisions of items 20, 22 and 24 with end surface 43.

Cover 40 also has peripheral walls 48 which extend from fixed ends 49 to free ends 50 to support internal surfaces 51. The materials and texture of such surfaces 51 and their extended distance are selected for engaging the engagement surfaces 37 of base 32. The advantages of base surfaces 37 and cover walls 48 with internal surfaces 51 are best seen in FIG. 1A.

FIG. 1A shows a base 32 (holding a device 10) in a typical phase of closure by a cover 40. Note that the engagement surfaces 37 and 51 of the base 32 and cover 40, respectively, have a close fit. Such fit is sufficiently close and the cover walls 48 are sufficiently long that the cover 40 substantially aligns to base 32 before closure progresses very far. Until accurate alignment is substantially made, cover portions such as shoulders 47 and corners 53–55, stay clear of the vulnerable items 20, 22 and 24 of device 10. Of course, when alignment is established, closure can progress according to arrow 56 without risk of injury to device 10.

FIGS. 1 and 2 also illustrate features which enhance airtight sealing of a container 30. For example, the base surfaces 37 and the cover walls 48 with their surfaces 51 may extend continuously around the periphery of container 30. Corner portions 38 are provided at the first end of the base 32, adjacent to engagement surfaces 37. Also, such portions 38 are extended continuously around the periphery of the base 32. Inside corner portions 58 are provided at the fixed ends 49 of walls 48, adjacent to engagement surfaces 51. Such portions 58 also extend continuously around the periphery of cover 40. The corner portions 38 and 58 are complementary with each other and provide a tight fit under proper engagement of cover 40 to base 32.

An adherent fabric 59, shown in phantom lines in FIG. 1, may be applied continuously about the periphery of container 30 over a joint formed between base 32 and cover 40. The use of shoulder portions 39 is preferred to assist in airtight sealing because such portions help to support the adherent fabric 59. However, if foreign matter is present at a joint area, shoulder portions 39 could stop the free ends 50 of the cover walls 48 before the corner portions 38 and 58 are fully engaged. Accordingly, the overlapping distance of surfaces 37 and 51 is shown in FIG. 1 as measured by D2. Such distance is less by distance D3 than the first distance provided for surfaces 37 which is shown as distance D1 in FIG. 1.

It will be appreciated that such distances are merely illustrative and not by way of limitation of the invention. For example, base 32 could be provided without shoulders 39, and the first distance could extend as far as one desires on base 32. However, any frictional features of surface 37 need only extend to about where the cover 40 terminates upon closure over the base 32.

FIG. 2 shows another embodiment which is further designed for maintaining airtight integrity and for self-adjusting to a drop in external air pressure. A container 60 is shown having most of the features (designated by the same numerals where desired) as that shown in FIG. 1 for container 30. However, the peripheral surfaces 37 (on a base 62) are provided on peripheral walls 63 which are substantially separated from the interior portion of base 62 for holding a device 10. The walls 63 are flexibly cantilevered from base 62 by provision of channels 64 located inwardly adjacent to such walls and of sufficient depth that the walls may resiliently flex inwardly. Such flexing accommodates a desired interference fit with the engagement surfaces 51 of the cover 40 during closure of a container 60. Such interference fit of surfaces 37 and 51 prestresses the surface materials and provides resistance to disengagement of cover 40 from base 62.

The channels 64 and the cantilevered walls 63 are preferably extended continuously around the periphery of base 62 for airtight integrity. Consequently, the channels 64 and walls 63 provide the self-adjusting pressure feature alluded to above. For example, the walls 63 are also resiliently flexible outwardly of container 60. When the internal pressure rises or when the external pressure drops significantly, the internal pressure causes walls 63 to flex against and improve engagement to cover 40.

Figure 3:
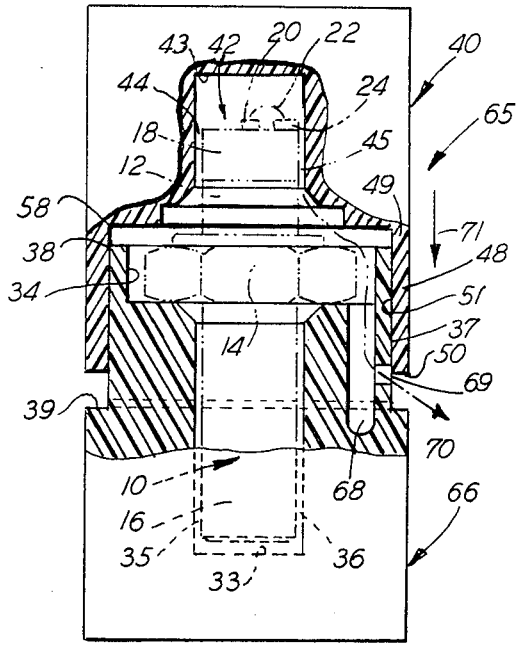
FIG. 3 is a partially sectioned, elevation view of a container having an air passageway and a relief port.
Figure 4:
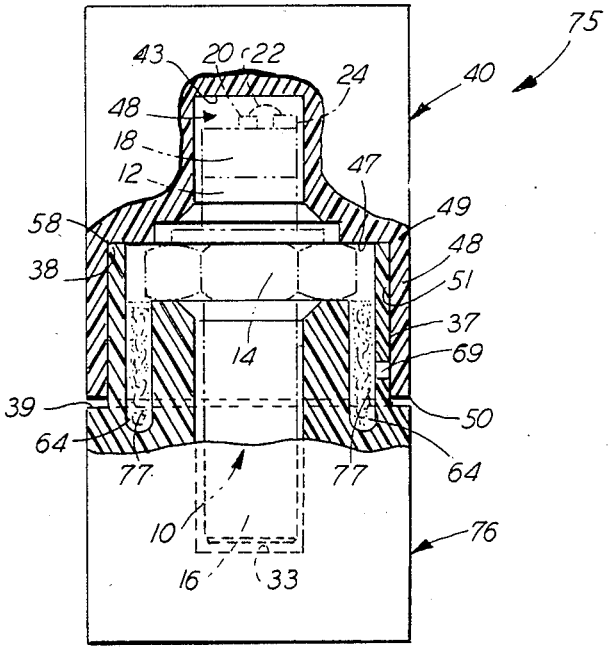
FIG. 4 is a partially sectioned, elevation view of a container having cantilevered walls, and channels utilized as air passageways to a relief port.

The pressure integrity of a container for a device 10 may be further improved by utilizing expedients for controlling internal air pressure caused, for example, by increased environmental temperatures. A container 65 is shown in FIG. 3 having most of the features (designated by the same numerals where desired) as that shown in FIG. 1. The quantity of air trapped within a container 65 is controlled when a cover 40 closes over a base designated by the numeral 66.

Base 66 is provided with a passageway 68 extending from counterbore 34, at least to a port 69 advantageously provided from a passageway 68 through a base engagement surface 37. Port 69 is open during at least a portion of the engaging of the engagement surfaces 37 and 51 of base 66 by cover 40, respectively. As seen in FIG. 3, the passageway 68 and the port 69 pass air trapped within container 65 according to the dotted line and arrow 70. Air flow continues until the free ends 50 of cover 40 are moved over, and the cover surfaces 51 close over, the port 69. For minimal entrapment of air in container 65, port 69 is provided on surface 37, just adjacent to the location of free ends 50 of walls 48 when cover 40 is closed. FIG. 3 shows a nearly ideal location for port 69 and also shows a condition of container 65 with cover 40 at a point of downward movement according to arrow 71 just before port 69 is closed.

In addition to bleeding air out of passageway 68 and port 69 during closure, the potential air spaces within container 65 may be kept to a minimum. For example, the position of end surface 43 and the size of clearances 35, 36, 44 and 45 and all other spaces may be minimally provided to just clear device 10 for loading into, closing over and removing the device from a container.

FIG. 3 is useful for teaching another aspect of air control. For example, one may select the fit between engagement surfaces 37 and 51 according to the frictional properties of the surfaces and materials of cover 40 and base 66. Instead of making such selection to avoid breaking a seal between cover and base, one could make the selection to permit, when a given level of air pressure is exceeded within a container 65, the cover 40 to slide until free ends 50 move over and relieve air from port 69 in base 66.

In a combination of the many features described above, FIG. 4 shows a container 75 utilizing a base 76. Base 76 has channels 64 to provide a passageway for passing air from around device 10 to a relief port. It will be appreciated that container 75 has most of the features (designated by the same numerals where desired) as that shown in FIGS. 2 and 3.

In a significant improvement over the known prior art, container 75 is provided with an air treating medium 77 for treating air which may backflow into the container 75. For example, the medium 77 may be merely a fiber such as cellulose to protect a device 10 from particulate matter. Alternatively, the medum may be a dessicant such as silica gel or may be a fiber containing a dessicant.

There have been illustrated herein certain practical embodiments and applications of the invention. Nevertheless, it is to be understood that various modifications and refinements may be made and used which differ from the disclosed embodiments without departing from the spirit and scope of the present invention.

What is claimed is:

1. A container for enclosing an article and for controlling air enclosed with the article, comprising:

a base having interior means for holding an article with a first portion of the article protruding from a loading end of the base, said base having peripheral surfaces extending over a first distance from the loading end to cover terminating means on the base, such surfaces being provided primarily for engaging cooperative surfaces for closing and for substantially hermetically sealing the container, there being at least one passageway extending from the interior holding means to a port at a peripheral engaging surface for passing air from the article in the container; and a cover having an interior cavity for closing over the first portion of the artice in a desired manner, said cover having peripheral walls containing free ends and fixed ends with internal surfaces therebetween for engaging the engagement surfaces of the base, wherein said engagement surfaces of said base and cover having a sufficiently close fit and said cover peripheral walls being sufficiently long that said cover substantially aligns to the base and stays clear of the article during closure such that unwanted contact of the cover to the first portion of the article is avoided, and said port being open during at least a portion of the engaging of the engagement surfaces of the base by the engagement surfaces of the cover, said port passing air trapped within the container until the free ends of the cover peripheral walls are moved over and the cover surfaces close over said port.

2. A container as in claim 1 wherein the passsageway extends to and the port is provided adjacent the location of the free ends of the cover walls when closure is completed, thereby minimizing the quantity and pressure of air trapped within the container during closure.

3. A container as in claim 2 wherein air spaces are minimally provided for just clearing the article for loading into, closing over and removing the article from the container, further comprising:

said engagement surfaces of the base and cover having a sufficiently close fit and said cover walls being sufficiently long that the cover substantially aligns to the base and the cover stays clear of the article during closure such that unwanted contact of the cover to the first portion of the article is avoided.

4. A container as in claim 2 wherein the fit between the engagement surfaces is selected according to the frictional properties of the surfaces and materials for permitting, when a given level of air pressure is exceeded within the container, the cover to slide along the base until the free ends of the cover walls move over and relieve such air pressure from the port in the base.

5. A container as in claim 4 wherein an air treating medium is provided in the air passageway for treating air which may backflow into the container.

6. A container as in claim 3 wherein the peripheral engagement surfaces of the base are provided on peripheral walls substantially separated from the article holding means, further comprising:

said walls being flexibly cantilevered from the base by providing inwardly adjacent to the walls, channels of sufficient depth that the walls resiliently flex inwardly to accommodate a desired interference fit with the engagement surfaces of the cover during sealing closure of the container;

said walls also being resiliently flexible outwardly to flex against and improve engagement to the cover when internal air pressure in the container rises above exterior air pressure; and said channels also providing the passageway for passing air from the article to the port.

* * * * *

UNITED STATES PATENT AND TRADEMARK OFFICE

CERTIFICATE OF CORRECTION

PATENT NO. : 4,586,608

DATED : May 6, 1986

INVENTOR(S) : Charles R. Fegley

It is certified that error appears in the above-identified patent and that said Letters Patent is hereby corrected as shown below:

Section 73 , "AT&T Bell Laboratories, Murray Hill, N.J." should read --AT&T Technologies, Inc., New York, N. Y.

Signed and Sealed this

Twentieth Day of January, 1987

*Attest:*

DONALD J. QUIGG

*Attesting Officer*

*Commissioner of Patents and Trademarks*